United States Patent [19]

Gallman

[11] 4,411,544

[45] Oct. 25, 1983

[54] POST BINDER BALL LOCK ASSEMBLY

[75] Inventor: Joseph L. Gallman, St. Louis, Mo.

[73] Assignee: Loose Leaf Metals Company, Inc., St. Louis, Mo.

[21] Appl. No.: 288,770

[22] Filed: Jul. 31, 1981

[51] Int. Cl.[3] ..... B42F 13/26; E05C 19/04

[52] U.S. Cl. ..... 402/69; 24/211 N; 24/221 K; 292/252

[58] Field of Search ..... 402/66, 69, 60, 61, 402/62, 65, 2, 59, 63, 64; 24/211 R, 211 L, 211 M, 211 N, 211 P, 221 K; 292/252; 248/411, 412, 336, 337

[56] References Cited

U.S. PATENT DOCUMENTS

| | | | |
|---|---|---|---|
| 2,816,471 | 12/1957 | Bachman | 24/211 N X |
| 2,865,076 | 12/1958 | Newton et al. | 402/60 X |
| 3,046,827 | 7/1962 | Myers | 24/211 N X |
| 3,495,307 | 2/1970 | Metz | 24/211 L |
| 3,617,081 | 11/1971 | Drucker | 292/252 |
| 3,980,327 | 9/1976 | Duran | 292/252 |

*Primary Examiner*—Paul A. Bell
*Assistant Examiner*—John S. Brown
*Attorney, Agent, or Firm*—Polster, Polster and Lucchesi

[57] ABSTRACT

A ball lock assembly is provided which permits preconstruction of certain ones of the assembly components. Consequently, the assembly, in kit form, has few parts, and may be integrated simply in a final binder construction by a binder manufacturer. The lock assembly includes a ball lock device having a first and second end. The ball lock device has an axial opening through it. A first end of the ball lock device receives a post of a suitable loose leaf metal used in the manufacture of a complete binder while the second end is constructed to permit attachment of a pull ring. The lock device includes a lock extension having a ball container movably mounted in it. A retaining sleeve is positioned between an internal diameter of the lock extension and an external diameter of the ball container. The sleeve permits the preassembly of the various parts of the ball lock device so that the lock assembly may be sold in kit form.

10 Claims, 7 Drawing Figures

POST BINDER BALL LOCK ASSEMBLY

BACKGROUND OF THE INVENTION

This invention relates to locking mechanisms for post-type binder metal utilized in conjunction with loose leaf binders, and in particular to an improved construction for a locking mechanism which permits the preassembly of the locking mechanism by the lock manufacturer, greatly simplifying the use of this kind of mechanism for binder manufacturers.

There are a number of different forms of loose leaf binders available in the marketplace. One form of these binders is known in the art as a post binder. A post binder generally includes a two-piece metal system in which a first metal backing has a plurality of male posts attached to it. A second metal backing has a corresponding number of female receptacles aligned to accept the male posts. Conventionally, a single locking mechanism is used to grasp one of the posts, thereby holding the combination together.

As will be appreciated by those skilled in the art, a large number of loose leaf binders are constructed by independent binder manufacturers. The "metals" used by the binder manufacturer are made by other independent manufacturers. Conventionally, the "metals" are inserted in the binder and attached thereto by the binder manufacturer.

Independent binding manufacturers have heretofore had difficulty in utilizing a post-type locking mechanism for binder systems because the locking mechanism is relatively complicated in construction, having a multiplicity of small parts which must be incorporated in the construction sequence. For example, FIG. 7 of the drawings, later described in greater detail, illustrates a prior art construction for this kind of locking mechanism in which ten separate parts were required for assembly. The parts include three small roller balls that function to lock the mechanism in position. The parts in general, and the roller balls in particular, are difficult to handle in a manufacturing situation. Consequently, ball lock mechanisms have not attained the kind of market penetration believed possible.

The invention described hereinafter permits the construction of a ball lock assembly containing only three parts which may be supplied by the "metals" manufacturer and easily assembled into a final product by the binder manufacturer. This greatly simplifies the construction process for post-type binders so that post-type binder metals have a substantially increased marketability.

One of the objects of this invention is to provide an improved ball lock assembly for loose leaf metals.

Another object of this invention is to provide a low cost lock assembly for loose leaf metals.

Another object of this invention is to provide a ball lock assembly that is simple to integrate in the manufacturing process used by an original equipment manufacturer during construction of a post-type binder.

Still another object of this invention is to provide a ball lock assembly which may be substantially preassembled.

Yet another object of this invention is to provide a ball lock assembly including a pull ring for loose leaf metals in which movement of the pull ring releases the locking mechanism.

Other objects of this invention will be apparent to those skilled in the art in light of the following description and accompanying drawings.

SUMMARY OF THE INVENTION

In accordance with this invention, generally stated, a ball lock assembly can be preassembled so that simplified integration of the assembly in to later construction steps is accomplished easily. The lock assembly, in kit form, includes a pull ring, an end cap and a locking device. The locking device structure includes a lock extension having a ball lock container movably mounted for movement in it. The ball lock container is biased toward a "locked position" by a spring. A retainer sleeve is mounted within the locking device and the biasing spring is mounted between the retainer and the ball container. The ball container has a first end adapted to receive a male post of a post-type metal binder and has a second end adapted to receive a pull ring which is employed to move the ball container between locked and unlocked positions.

DESCRIPTION OF THE PREFERRED EMBODIMENT

Figure 1:
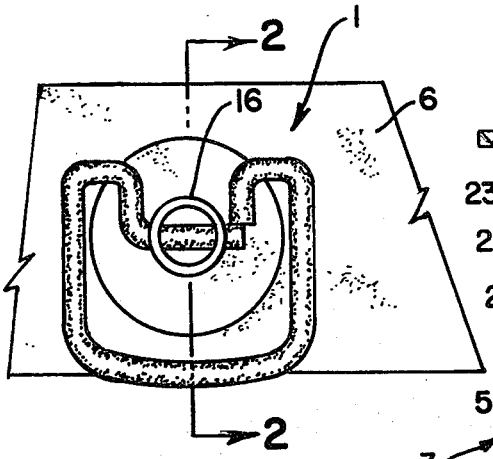
FIG. 1 is top plan view, partly broken away, of ball lock assembly of this invention.

Referring now to FIG. 1, reference numeral 1 indicates one illustrative embodiment of ball lock assembly of this invention. The ball lock assembly 1 preferably is provided in a three-piece kit form, which includes a locking device 3, an end cap 4, and a pull ring 5, best observed in FIG. 5.

The ball lock assembly 1 is intended for use in conjunction with loose leaf metals designed for incorporation in post-type binders. Post-type binders conventionally include first and second L-shaped brackets 6 and 7, respectively. In the embodiment illustrated, the bracket 6 is adapted to receive the ball lock assembly 1, while the bracket 7 has at least one male post member 8 attached to it. Commonly a three post construction is used, and the ball lock assembly is positioned in the middle location. Usually, the binder manufacturer buys the brackets 6 and 7 and the lock assembly from a manufacturer of those parts, and inserts the brackets into a suitable binder cover. Prior to insertion of the brackets, the posts and lock assemblies are attached to the brackets by any convenient method. Peening or coining is a commonly used method, for example. The post member 8 and a lock extension 21 may be attached to the brackets by the metals manufacturer, if desired.

Figure 3:
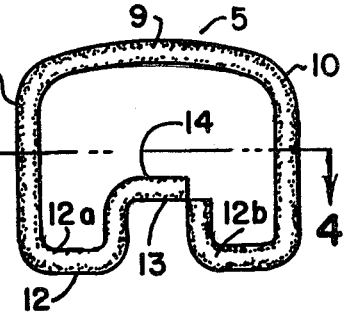
FIG. 3 is a view in side elevation of the pull ring utilized in conjunction with the locking device of FIGS. 1 and 2.
Figure 4:
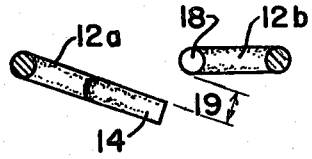
FIG. 4 is a sectional view taken along the line 4—4 of FIG. 3.
Figure 5:
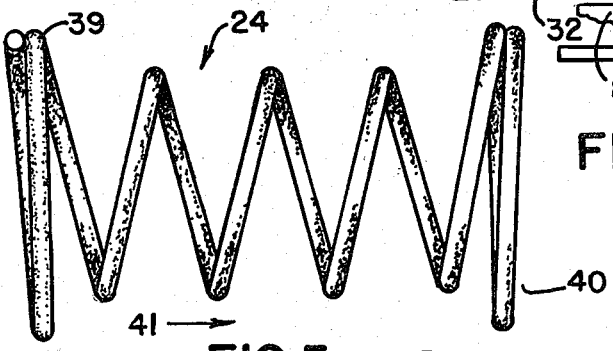
FIG. 5 is an enlarged side elevational view of a baising spring utilized in conjunction with the device of FIG. 1.
Figure 6:
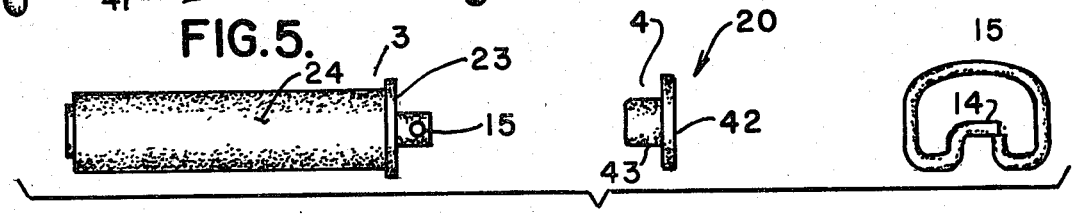
FIG. 6 is an exploded view showing a three-piece kit available with the ball lock assembly construction of this invention.

Referring now to FIG. 3, it may be observed that the pull ring 5 is an elongated device having a top part 9, sides 10 and 11. The ring 5 also has a split bottom 12. The bottom 12 is defined by a first part 12*a*, a second part 12*b* and a ball lock offset portion 13. The offset portion 13 is provided to enable the inertion of an end 14 of the portion 12*a* of the pull ring 5 into an opening 15 in an end 16 of a ball container 17. In order to facilitate that insertion, the end 14 is separated from an end 18 of the portion 12*b* of the pull ring 5 as supplied in a kit 20. The kit 20 is illustrated in FIG. 5. During manufacturing, a binder manufacturer forces the end 14 to a position approximately adjacent the end 18 to close the ring 5, as later described in greater detail.

The locking device 3 includes the lock extension 21, the ball container 17, a biasing spring 24, a retainer means 22 and a support means 23.

The lock extension 21 is a cylindrically shaped device having an outer surface 25 and an inner surface 26, with a material thickness therebetween. The surface 26 delimits an axial opening 27 through lock extension 21. An end 28 of the lock extension 21 is adapted to receive the post 8, while an end 29 has an annular shoulder 30 formed in it along its outer surface 25. The shoulder 30 is sized to receive the support means 23. Support means 23 preferably is an annulus sized to receive the end 29 of the lock extension 21 in a friction fit. The support means preferably is attached to the lock extension 21 by any convenient method. Again, coining of the material thickness of the lock extension along the end 29 works well, for example.

The inner surface 26 of the lock extension 21 is designed to converge from a first, large internal diameter 31 toward a second, small diameter 32 along the end 28. The convergence of the surface 26 along the end 28 delimits a truncated, frusto-conical shaped area along the axial opening 27 at that end of the lock extension 21.

Ball container 17 is a cylindrically shaped device having an external wall 50 and an internal wall 51 separated by a material thickness 2. The external wall 50 defines a first large diameter portion 33 and a second smaller diameter portion 34, which delimit a shoulder 35 along the exterior wall 50 surface of the ball container.

An end 45 of the ball container 17 has a plurality of openings 36 extending radially through the material thickness of the ball container 17. The openings 36 are sized to receive a plurality of roller balls 37 in a conventional manner. That is to say, the roller balls 37 may be placed in the opening 36 from the wall 50 side of the container 17, but have a diameter chosen so that they are prevented from entering an axial opening 38 defined by the wall 51 of the ball container 17. The roller balls 37 bear against the truncated frusto-conical portion of the lock extension in the intermounted position of the ball container so as to vary the diameter of the axial opening 38 of the ball container 17 along a plurality of positions defined by the relationship of the roller balls 37 with the frusto-conical portion of the lock extension 21. The axial opening 38 in the ball retainer 17 is sized to receive the post 8 in at least the large diameter position defined by the location roller balls 37 with the lock extension 21, and to tightly grip the post 8 and the small diameter portion of roller balls 37 with the lock extension 21.

As indicated, the ball container 17 is movable axially within the lock extension 21 and is biased toward the small diameter position of the roller balls 37 by the spring 24. Spring 24 is held positionally between the shoulder 35 and the retainer sleeve 22. Spring 24 includes a first end 39, a second end 40 and a body portion 41. As best shown in FIG. 5, the ends 39 and 40 are enlarged diametrically with respect to the body portion 41. This enlargement permits easy placement of the spring 24 along the shoulder 35 and facilitates the engagement of the spring 24 with the retainer 22.

Retainer 22 is an annular device press-fit within the lock extension 21 in a conventional manner. It is positioned within the lock extension 21 so as to maintain a compression force on spring 24. As those skilled in the art will appreciate, the roller balls 37 are relatively small in size. By use of the retainer 22, a manufacturer of the lock ball assembly 1 may preconstruct the locking device 3 for supply in its constructed form. That is to say, the ball container 17 may have the roller balls 37 inserted in the openings 36 and placed within the lock extension 21. The spring 24 thereafter may be inserted over the end 16 of the ball retainer 17. The retainer means 22 is then press fit within the lock extension 21. This maintains the position of the spring 24 and ball retainer 17 until the end cap 4 is installed in lock extension 21, as later described. The pull ring 5 is attached to the ball retainer 17 at the opening 15. The pull ring 5 enables one to move the ball container 17 axially between a variety of positions. Movement is accomplished by rotating the pull ring 5 to a vertical position referenced to FIG. 2 and lifting the ring 5. Movement of the ring 5 acts to lift the ball retainer 17 axially upwardly. That movement acts to release the post 8 from locking engagement with the roller balls 37.

Figure 2:
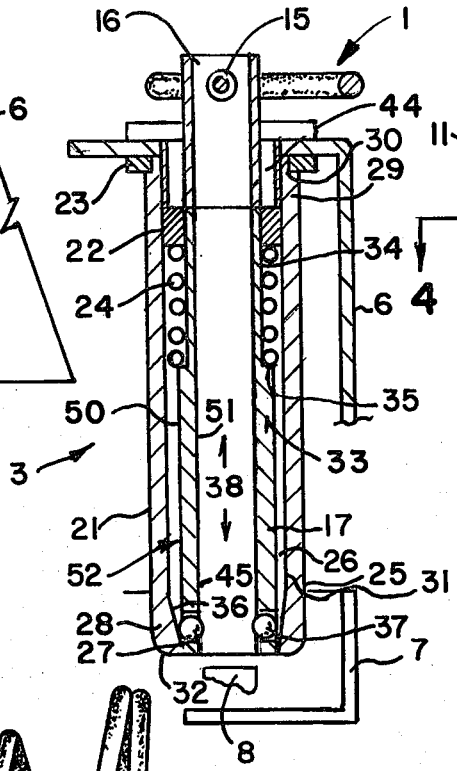
FIG. 2 is a sectional view taken along the line 2—2 of FIG. 1.

End cap 4 is conventional and includes a broad upper surface 42 and a depending cylindrical portion 43 which is insertable into the lock extension 21 in a press fit. Both the cylindrical portion 43 and surface 42 has an axial opening 44 extending through them. The opening 44 sized to permit the end 16 of the ball retainer 17 to extend through it, as best shown in FIGS. 2 and 5.

It thus may be observed that the kit 20 may comprise three individual components, and that the ball lock assembly 1 may be utilized in conjunction with the bracket 6 simply by positioning the lock extension 21 adjacent a suitable opening in the bracket 6, and placing the end cap 42 into the lock extension 41 after that placement. This clamps the bracket 6 between the end cap 4 and the support means 23. After the pull ring 5 is inserted in the opening 15 as described above, the ends 14 and 18 of the pull ring are closed to complete the manufacturing steps.

Figure 7:
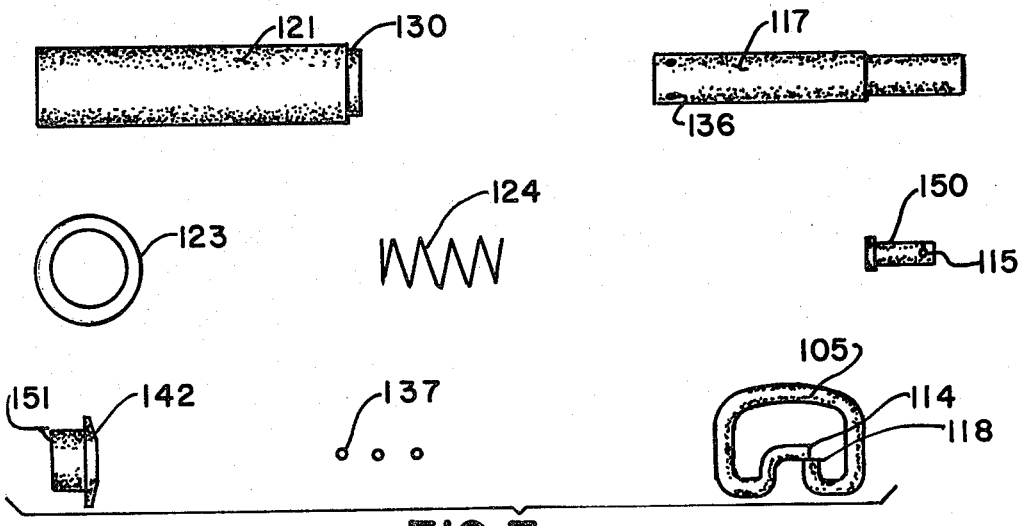
FIG. 7. PRIOR ART
FIG. 7 is an exploded view showing the ten-piece construction of prior art ball lock assemblies.

Previous ball lock designs shown in FIG. 7 differ from the device of this invention in that each of the parts were provided individually, the binder manufacturer having to make the overall assembly. Thus, as shown in FIG. 7, a lock extension 121 was sized to receive a ball container 117. An end piece 150 was inserted in the ball container 117 during assembly. A support washer 123 likewise was inserted along an end 130 of the lock extension 121. A spring 124 was sized to abut an end 151 of an end cap 142. A plurality of roller balls 137 were individually fitted in a corresponding plurality of openings 136 while a pull ring 105 was closed at its ends 114 and 115 and required separation prior to insertion into the opening 115. I have greatly simplified the use of post-type binder assemblies by binder manufacturers by my improved construction which employs the spacer 22 to position the spring 24, by providing the spacing 19 between the ends and 14 and 18 of the pull ring 5, and by using a one-piece ball retainer construction where the ball retainer also is adapted to receive the pull ring. Because of the various modifications, described above, a three-piece lock assembly kit which is readily adaptable for use in the production of post binders can be supplied.

Numerous variations, within the scope of the appended claims, will be apparent to those skilled in the art in view of the foregoing description and accompanying drawings. Thus, the number of roller balls employed in conjunction with the ball retainer may vary. Specific design silhouettes described above also may be altered, if desired. For example, the design of the pull ring, while described as generally rectangular, may be oblong or elliptical, for example. Likewise, while I find the enlarged spring ends 39 and 40 employed with the spring 24 to be advantageous, a conventional single diameter spring may be utilized. Although the lock extension and ball container were described as cylindrical, other design shapes are compatible with the broader aspects of this invention. These variations are merely illustrative.

Having thus described the invention, what is claimed and desired to be secured by Letters Patent is:

1. A kit for a ball lock assembly for use in conjunction with loose leaf metals, comprising:

a pull ring;

an end cap having an axial opening in it; and a locking device formed as an assembly and including a lock extension having an axial opening therethrough, said lock extension having a first end adapted to be at least partially closed by said end cap and a second end sized to permit reception of a loose leaf metal post of a binding system, a one-piece ball container having first and second ends, a plurality of ball lock means mounted in one of said first and second ends, means for mounting said pull ring on the other of said first and second ends of said ball container, said ball container having an external surface defining a first large diameter portion and a second small diameter portion along said surface to delimit a first shoulder therebetween, retainer means mounted in said lock extension between said lock extension and said ball container, and a spring compressed between said retainer means and said first shoulder of said ball retainer.

2. The kit of claim 1 including a support annulus, an external surface of said lock extension having a second shoulder formed in it for receiving said annulus, said annulus being secured to said lock extension.

3. The kit of claim 2 wherein said pull ring has a predetermined shape having first and second ends, the ends of said pull ring being separated to permit attachment thereof to said ball container.

4. The kit of claim 2 wherein said lock extension has an internal surface defining a frusto-conical surface internally thereof and arranged so that the frusto-conical surface defines a smaller diameter for the axial opening therethrough at the distal end of said lock extension.

5. The kit of claim 4 wherein said pull ring is rotatably mounted to said ball container.

6. The kit of claim 5 wherein said spring is a coil compression spring having a first end, a body part, and a second end, the diameter of said coil spring being less than the diameter of said first and said second ends of said spring.

7. A kit for a ball lock assembly for use in conjunction with loose leaf metals, comprising:

a pull ring;

an end cap having an axial opening in it; and a locking device formed as an assembly and including a lock extension having an axial opening through it, said lock extension having a first end sized for interconnection with said end cap, and a second end sized to permit reception of a loose leaf metal post of a binding system, the axial opening along said last mentioned end being defined by an internal wall, including a first large diameter portion and a second small diameter portion along said second end;

a one-piece ball container having first and second ends, said ball container being sized to pass the second end of said lock extension, a plurality of ball lock means mounted in one of said first and said second ends, means for mounting said pull ring on the other of said first and said second ends of said ball container, said ball container having an external surface defining a first large diameter portion and a second small diameter portion along said surface to delimit a first shoulder therebetween, retainer means mounted in said lock extension between said lock extension and said ball container, and a spring compressed between said retainer means and said first shoulder of said ball retainer.

8. The kit of claim 7 wherein said spring is a coil compression spring having a first end, a body part, and a second end, the diameter of said coil spring being less than the diameter of said first and said second ends of said spring.

9. The kit of claim 7 further including a support annulus, an external surface of said lock extension having a second shoulder formed in it for reception in said annulus, said annulus being secured to said lock extension.

10. The kit of claim 9 wherein said pull ring has a predetermined shape having first and second ends, the ends of said pull ring being separated to permit attachment thereof to said ball container, said pull ring being pivotally mounted to said ball retainer.

* * * * *